United States Patent [19]

Slottag

[11] Patent Number: 4,517,430

[45] Date of Patent: May 14, 1985

[54] MICROWAVE HEATING DEVICE WITH CONSTANT TEMPERATURE CONTROL OF THE MAGNETRON

[75] Inventor: Mark J. Slottag, Chicago, Ill.

[73] Assignee: GCA Corporation, Bedford, Mass.

[21] Appl. No.: 493,368

[22] Filed: May 10, 1983

[51] Int. Cl.[3] ..... H05B 6/68

[52] U.S. Cl. ..... 219/10.55 B; 219/10.55 R; 315/39.51; 331/86

[58] Field of Search ..... 219/10.55 B, 10.55 R; 331/86, 87; 34/1; 315/39.51, 39.59, 115-118, 98, 100, 102, 104, 105; 328/285, 261, 269

[56] References Cited

U.S. PATENT DOCUMENTS

| | | | |
|---|---|---|---|
| 3,829,649 | 8/1974 | Igarashi | 219/10.55 B |
| 4,017,702 | 4/1977 | Harmon et al. | 219/10.55 B |
| 4,121,149 | 10/1978 | Seltzer | 219/10.55 B |
| 4,217,477 | 8/1980 | Matsubara et al. | 219/10.55 B |
| 4,223,195 | 9/1980 | Bechtel | 219/10.55 B |
| 4,228,809 | 10/1980 | Paglione | 219/10.55 B |
| 4,233,478 | 11/1980 | Stahl et al. | 219/10.55 B |
| 4,236,055 | 11/1980 | Kaminaka | 219/10.55 B |
| 4,268,779 | 5/1981 | Eichelberger et al. | 219/10.55 B |
| 4,314,197 | 2/1982 | Sandler et al. | 219/10.55 B |
| 4,323,861 | 4/1982 | Sandler et al. | 219/10.55 B |

FOREIGN PATENT DOCUMENTS

| | | | |
|---|---|---|---|
| 47-2348 | 1/1972 | Japan | 219/10.55 B |
| 52-51134 | 4/1977 | Japan | 219/10.55 B |
| 53-12536 | 2/1978 | Japan | 219/10.55 B |

*Primary Examiner*—Philip H. Leung

*Attorney, Agent, or Firm*—Pahl, Lorusso & Loud

[57] ABSTRACT

A heating device for use in laboratories and the like comprising an oven housing having a magnetron tube, power control circuitry for the magnetron tube, a timer for determining an amount of pulse power for the magnetron tube, a settable heating time switch with display, a settable venting time switch and display, and magnetron tube resistance heating structure directly, physically attached thereto with thermostatic control therefore for accurately, and by a predetermined amount, heating the magnetron tube prior to operation of the overall heating device. Because the temperature of the magnetron tube is very accurately maintained all of the changeable operating controls for the magnetron respond predictably and with a high degree of accuracy, and therefore when the heating device is used in laboratory applications for heating and drying a plurality of samples individually, each sample can be predeterminedly heated and dryed in a predicable manner like the previous samples. By using percentage of power switches and circuitry together with a variable pulse power control, the overall heating can be accurately controlled and predicted for small samples, medium size samples, and very large samples.

18 Claims, 14 Drawing Figures

SCHEMATIC DIAGRAM
VARIABLE POWER CONTROL CIRCUIT PCB (A20)

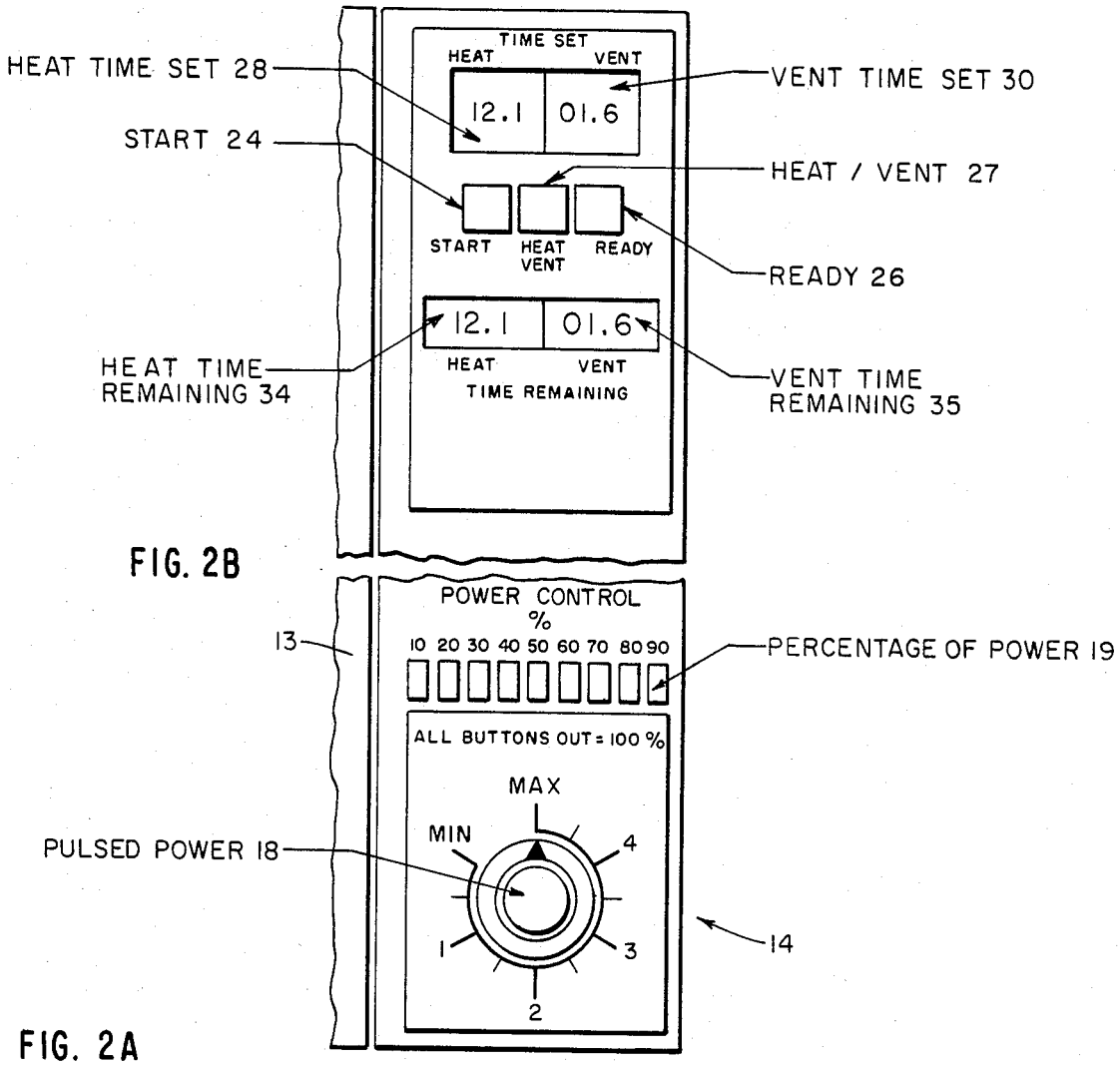
FIG. 2B
FIG. 2A
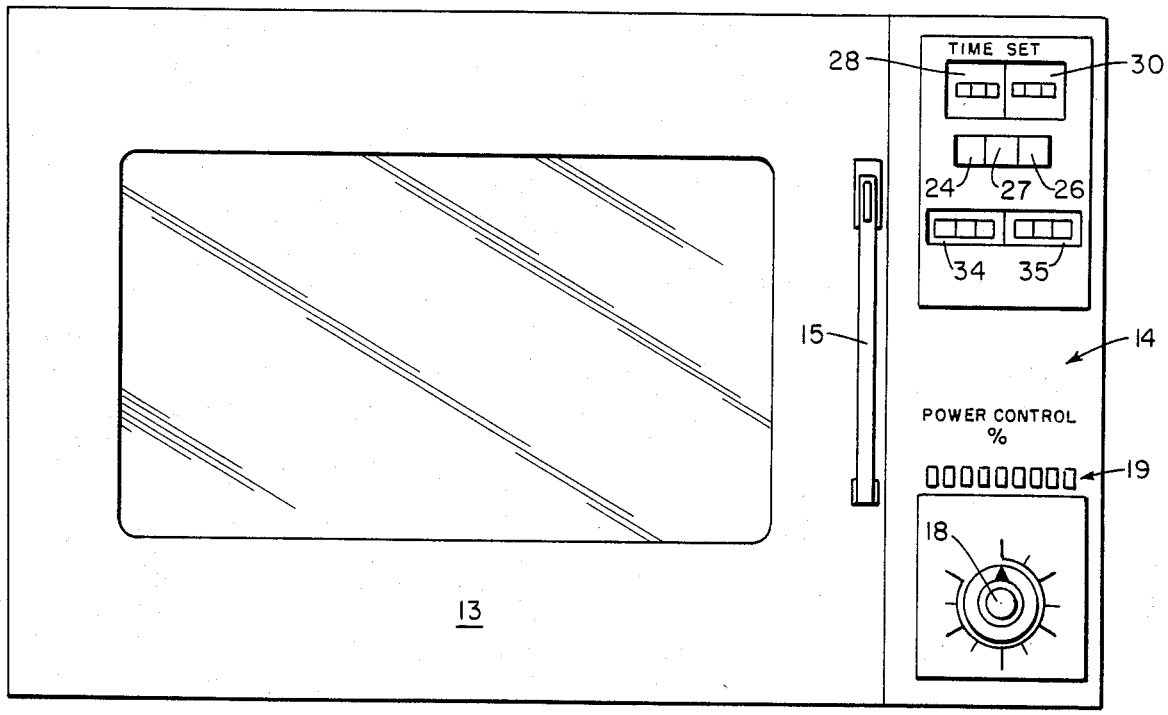

WH/BL
J8
P8
NEUT.
PS1
GND.
BR
HOT
(+)
(-)
GR
E2
BK/WH
BK
POWER SUPPLY GROUND
WH/BL
BR
CR1
VENT RELAY
BK
A
K2
B
COIL
VT
BK
WH/RD
WH/BK
W2
VT
WH/BL
OR
OR
BK
BR
RD
WH/BL
WH
2
R4
1
WH/BK/BR
BK
BK
BR
S3
WH/BR
WH
BR
BR
WH/BL
GATE
VL
MT1
WH/OR
CR3
WH/OR
WH/OR
MT2
WH
3
T2
2
WH/OR
-3
A20
YL
-2
POWER CONTROL
C1
V1
4
1
WH/BL
BK
BK

NOTES

1. INTERLOCK SWITCHES S5, S6, S7, ARE IN DOOR OPEN POSITION.
2. RELAY CONTACTS FOR K1 & K2 ARE SHOWN IN THE DE-ENERGIZED POSITION.

MICROWAVE HEATING DEVICE WITH CONSTANT TEMPERATURE CONTROL OF THE MAGNETRON

BACKGROUND OF THE INVENTION

1. Field of the Invention

This invention relates generally to microwave heating devices and specifically for such devices wherein the device may be used for drying materials containing water much faster than conventional heating structures particularly for use with laboratories and the like.

2. Description of the Prior Art

A common problem with known heating devices of conventional type is that when used for heating or drying laboratory samples a relatively long time period is required for achieving the desired result. Also, it is generally desirable in lab work to heat small samples with finely controlled analytical heating of such samples. However, known type heating devices to date have not been able to accomplish the results with the degree of accuracy, precision and predictability desired.

There have been devices made to heat by microwave technology, but often times they are still far from being completely effective. Often times, while the microwave-type heating device will speed up the overall heating process, control thereof is relatively inaccurate and unpredictable, and it is very difficult to repeat each of a plurality of tests with the same degree of precise control of the overall heating for each and every sample. In order to accomplish these desired results, new and novel structure for controlling the heating by microwaves is disclosed in this application.

Existing prior patents which may be pertinent to the present invention are as follows:

A patent to Kaminaka U.S. Pat. No. 4,236,055 discloses a microwave oven employing a Triac 18 in the power circuit for the magnetron. In addition, a cooling fan 10 remains energized after the magnetron is switched off to cool the high voltage transformer 7, the microprocessor 2, and the magnetron 9.

The patent to Stahl et al, U.S. Pat. No. 4,233,478, shows a temperature monitoring apparatus in a microwave-type oven.

The patent to Paglione U.S. Pat. No. 4,228,809 discloses another type of temperature controller for a microwave heating device.

U.S. Pat. Nos. 4,121,149; 4,223,195; 4,268,779; 4,314,197; and 4,323,861 all disclose various power control circuits in microwave ovens each of which includes a Triac.

However, none of the known prior art devices offer the new and novel features of the invention.

SUMMARY OF THE INVENTION

An object of the present invention is to provide a precisely controlled microwave heating device for use in drying materials containing water much faster than conventional heating devices.

Another object of the present invention is to provide a microwave heating device which can pulse a magnetron at full power for varying periods of time in order to provide different heat outputs, in addition structure is included for energizing the magnetron for a portion of each input power cycle depending upon a heat output setting to provide very uniform heating, and additional structure is provided for holding the magnetron at practically a constant temperature for the purpose of providing a very steady power output. The overall heating device is very accurately controllable and predictable.

Another object of the present invention is to provide a microwave heating device for use in laboratories and other test facilities which can be quite accurately set, and reset, so that each of a plurality of individual tests can be repeated with consistent, predictable, very steady heating of samples to be dried.

A further additional object is to provide a heater and thermostat combination structure physically attachable to a magnetron tube of a microwave oven for holding the magnetron at a constant temperature during the stand-by period of the magnetron. The overall purpose being to provide microwave heating which is very predictable, resettable and repeatable in power output during each heating period.

The present invention has a number of new and novel features. Among them are precise, accurate control of a heating device which is usable by laboratories and the like for heating test samples, and particularly for heating a number of such samples wherein it is highly desirable that the overall heating power be repeatable and reproducable almost identically to the ones therebefore.

The microwave heating device of the present invention is especially designed for laboratory use. Its unique features provide the researcher, technologist, and technician with a new versatile heating device capable or rapid, large volume heating, finely controlled analytical heating of small samples, and extension of results from laboratory testing to industrial scale-up. Examples of general application for which the present invention can be used are as follows:

1. Moisture and solids analysis
2. Sterilization and pasteurization
3. Media preparation
4. Sponge drying
5. Rubber heating
6. Refraction drying
7. Foundry core curing, and
8. Insulation drying.

Microwaves are short electromagnetic waves of the same family as those used in radio, TV, and radar. Although microwaves have no identifiable temperature of their own, they can create temperature rises in products and water. In the same manner as an electrical range, microwaves pass freely through the air until they encounter a resistive load. Water is resistant to microwaves and will absorb them, increasing its molecular activity to such an extent that heat is created through internal friction. Thus, heat generated by a microwave is the result of microwave interaction with water molecules contained in the samples.

Microwaves, which in character are short, straight waves, are reflected by metals. When transmitted into the microwave cavity, they are reflected off the metal walls, roof, and floor of the cavity and absorbed by the samples. Glass, paper, and most plastics are transparent to microwaves and will permit microwaves to pass through them with little or no absorption.

Microwaves heat at a very fast rate, dependent upon the size of the load and output power. Therefore, it is the time setting and the power setting which must be varied according to the amount of sample mass being heated. The microwave oven needs no pre-heating period as does a conventional oven.

The speed of a microwave oven is very apparent when heating individual single-unit quantities of sample.

As the energy is utilized by a sample in the microwave heating device, any increase in heating time will cause an additional amount of microwave energy to be used to heat the sample.

To insure a long, useful product life, the present microwave heating device incorporates several component protection features. The oven has a thermal sensor to protect the magnetron tube from unintentional overheating, and a timer shuts off automatically to insure a longer life of all electrical components.

The magnetron tube and other components are forced-air cooled by a blower. Air is taken in through an opening in the rear of the microwave heating device and passes through the blower and past the components mounted inside the device. Also some of the air is ducted into the oven cavity to exhaust vapors from the sample. The blower runs whenever the magnetron is activated, and for whatever additional time is dialed in for a desired venting period.

The present microwave heating device has an oven-type housing, a magnetron tube contained therewithin together with suitable waveguide structure, electrical circuitry for energizing the magnetron, adjustable structure for controlling the amount of power to the magnetron from 10 to 100 percent or power in steps of 10 percent a variable control for varying the amount of pulse power for the magnetron, indicating and display structure which is programmable for various times to control the energization of the magnetron tube, a blower for cooling the components together with display and control structure therefor, and additional resistance heating structure with thermostatic control physically attached directly to the magnetron for heating and maintaining a desired amount of heat to the magnetron before and during the operating period thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2A is a front view of the heating device and FIG. 2B is an enlarged front elevational view of the control panel per se of the heating device of FIGS. 1 and 2A;

DESCRIPTION OF THE PREFERRED EMBODIMENT

Figure 1:
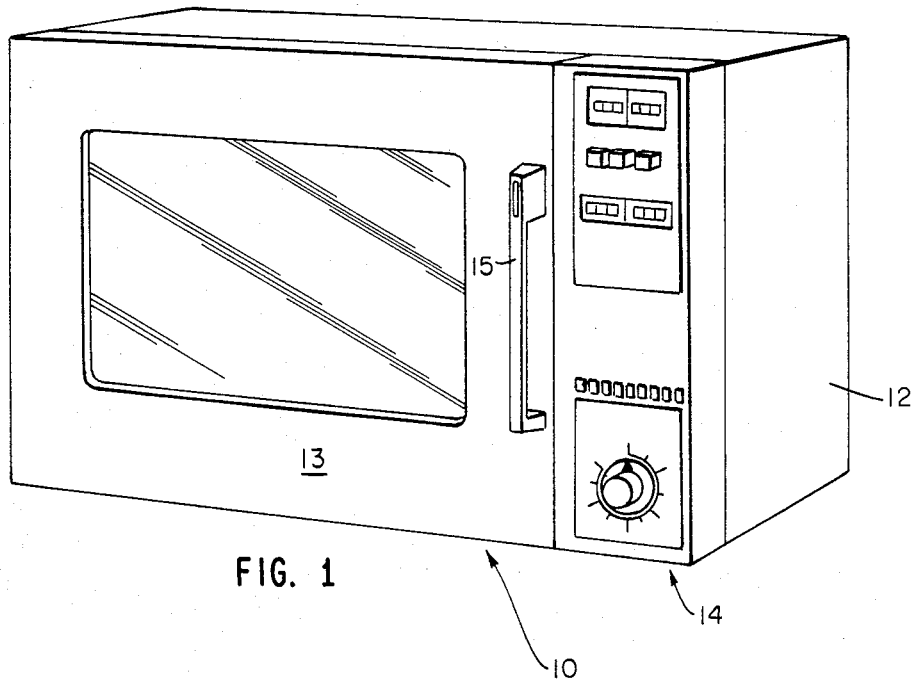
FIG. 1 is a perspective view of the microwave heating device of the present invention.

Referring to FIG. 1 of the drawing, reference numeral 10 indicates in general the heating device of the present invention. The basic housing structure 12 is of conventional microwave oven-type construction having a door 13 with handle 15, and has an inner chamber which supports the samples or other materials to be heated with appropriate microwave energy generating structure, i.e., a magnetron tube and system. The housing also contains the electrical wiring, the energizing and control elements for suitably energizing the magnetron tube, etc. A control panel 14 includes the switch elements which are user actuated to produce the various combinations of power output from the magnetron tube.

FIGS. 2A and 2B show in greater detail the control panel 14 of FIG. 1. At the top of the control panel are provided two dial thumb wheels switches. The first one 28 is for setting the time of heating. The other thumb wheel switch 30 determines the amount of additional time the vent blower is "on" independently of the microwave heating. The purpose of the vent being to exhaust vapors from the oven. Each control is set by the user of the device for the desired amount of time for the respective heating and venting cycles. The visual display indicates whatever setting the operator selects.

Directly below the thumb wheel switches 28 and 30 are a star button 24, a magnetron ready pilot light 26 and a heating and venting pilot light 27. The start button 24 is pressed when the operator is ready to start a desired heating cycle. The magnetron ready light 26 glows when the magnetron has been sufficiently heated to be at its best operating temperature, and is part of the very heart of the present invention. While microwave heating may be done with the ready light 26 "off", indicating that the magnetron is not up to desired operating temperature, the desirable benefits of the present invention will not be effected with such operation. To achieve the desired benefits of the present invention, the ready light 26 should be "on", indicating that the magnetron is heated to the best operating temperature, and is being maintained at this temperature. Tests have been conducted which indicate that the increased efficiency and the new and unexpected results achieved by the present invention are definitely a function of the magnetron being operated at a predetermined degree of heat and its being maintained at this desired operating temperature during use of the device. The pilot light 27 glows whenever the "heat" and/or "vent" time cycles are energized.

Directly below the start button 24 and pilot lights 26,27 are two windows having light emitting diodes (LEDs) therewithin. A heat time remaining window 34 will upon initial actuation of start button 24, indicate the same reading as the heat time set on dial 28. Then as the heating operation of the oven continues, appropriate circuitry within the oven will cause the LEDs to count down thus showing the remaining time in the heat cycle. For example, if the "heat" thumb wheel switch 28 is set for 10 minutes, initially upon depressing start button 24, the LEDs behind window 34 will indicate the number 10.0. As the heating cycle progresses and the time cycle expires, the LEDs will indicate 9.9 minutes, 9.8 minutes, etc. until the entire heat cycle is completed, at which time the LEDs will diminish to zero or become blank.

Similarly, at the expiration of the heating cycle, the venting cycle will then continue in the same manner. For example, if 25 minutes has been set into the thumb wheel vent time switch 30, when the heat time remaining window 34 indicates zero then almost simultaneously window 35 will indicate 25.0 minutes, and then descend to 24.9 minutes, 24.8 minutes, and so forth down to zero. When zero is reached the vent cycle will be ended. From the foregoing, it can be concluded that a vent cycle due to energization of the built-in blower motor is in effect at all times that the heating cycle itself is energized, and an additional venting cycle may follow as determined by the vent time set switch 30.

The power control elements for the magnetron are arranged in the lower half of control panel 14. Mounted slightly below the center of the control panel are a plurality of nine push button switches 19. These switches control the percentage of power of the magnetron output in ten discreet steps. In none of the push buttons are depressed, then 100 percent of microwave power from the magnetron is effected. However, the actual power output from the magnetron can be varied from 10 percent to 90 percent of full power, in steps of 10 percent by depressing the appropriate button. For example, in the magnetron system wherein full power corresponds to approximately 650 watts, 90 percent power is approximately 585 watts, 80 percent power is approximately 520 watts, and so forth.

The variable control element 18 at the bottom of the control panel is for pulsed power control. By rotating the pulsed power knob 18, it is possible to further modulate the magnetron in a manner which is of significance when heating small samples, thermolabile samples, melting frozen samples, etc. In the maximum counterclockwise position "MAX" the magnetron is "on" continuously throughout the heat cycle. However, as the dial 18 is rotated clockwise, the magnetron is energized in a pulsed manner "on" and "off" over a 12 second duty cycle. This effects the following pulsed power control of the magnetron. For the minimum position "MIN" of the dial, the magnetron is pulsed "on" for 1 second and is "off" for 11 seconds. At the number 2 position, which is half-way between maximum and minimum, the magnetron is pulsed "on" for 6 seconds and "off" for 6 seconds. At the maximum position the magnetron is pulsed "on" for 12 seconds and "off" for zero seconds, i.e., "on" continuously. The positions intermediate the ones listed are in direct proportion thereto. Thus, by using the percentage of power switches 19 and the pulsed power control 18 various combinations of output power can be achieved. For example, if button three is depressed for 30 percent power and the pulse power control is set at 4, then based on an overall total power output of 650 watts, 195 watts will be produced for 9.5 seconds and zero watts will be produced for 2.5 seconds. If button nine is depressed for 90 percent power and the pulse power control is set at 1, 585 watts will be produced for 4 seconds, and zero watts will be produced for 8 seconds. Thus, it is quite clear that very accurate and precise control of the power output of the magnetron heating apparatus of the present invention can be accomplished.

Figure 6:
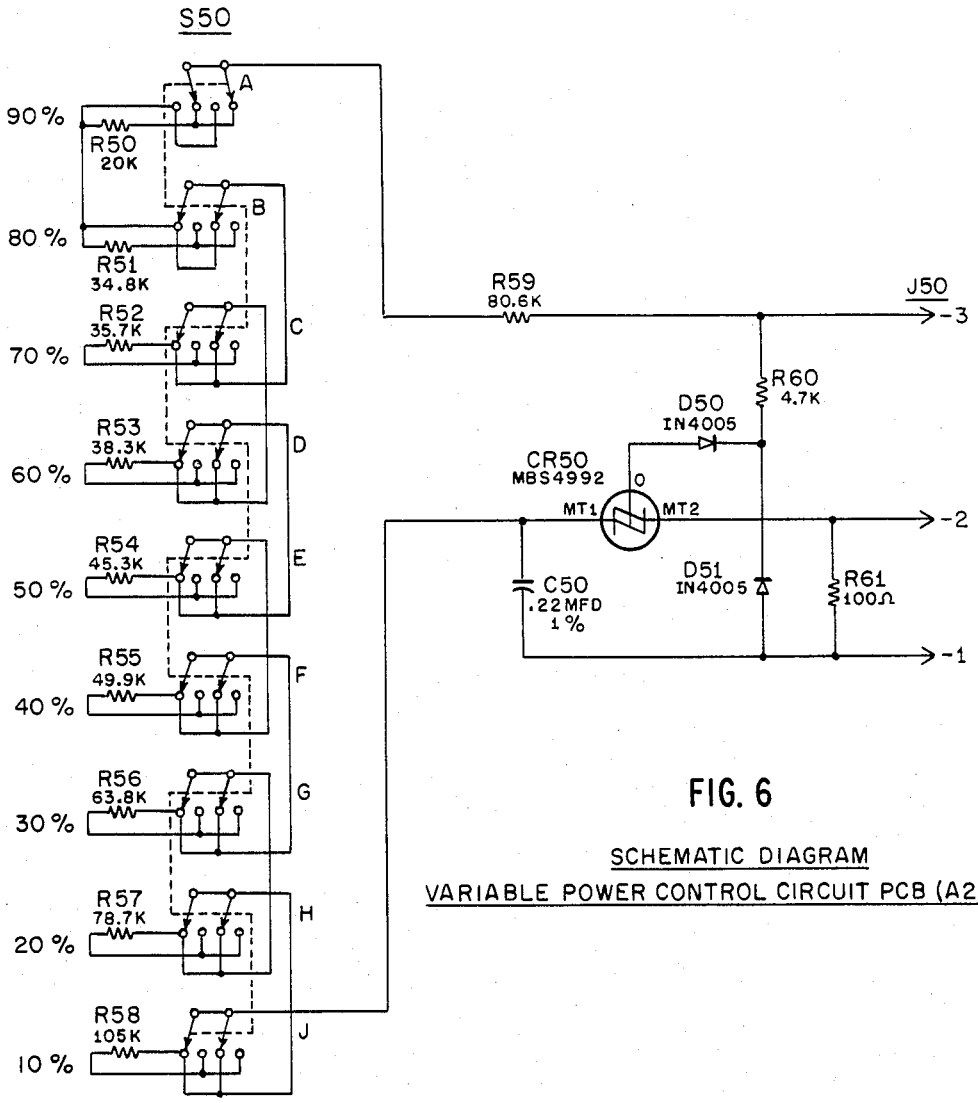
FIG. 6 is a schematic diagram showing the circuitry of the variable power control printed circuit board.
Figure 3A:
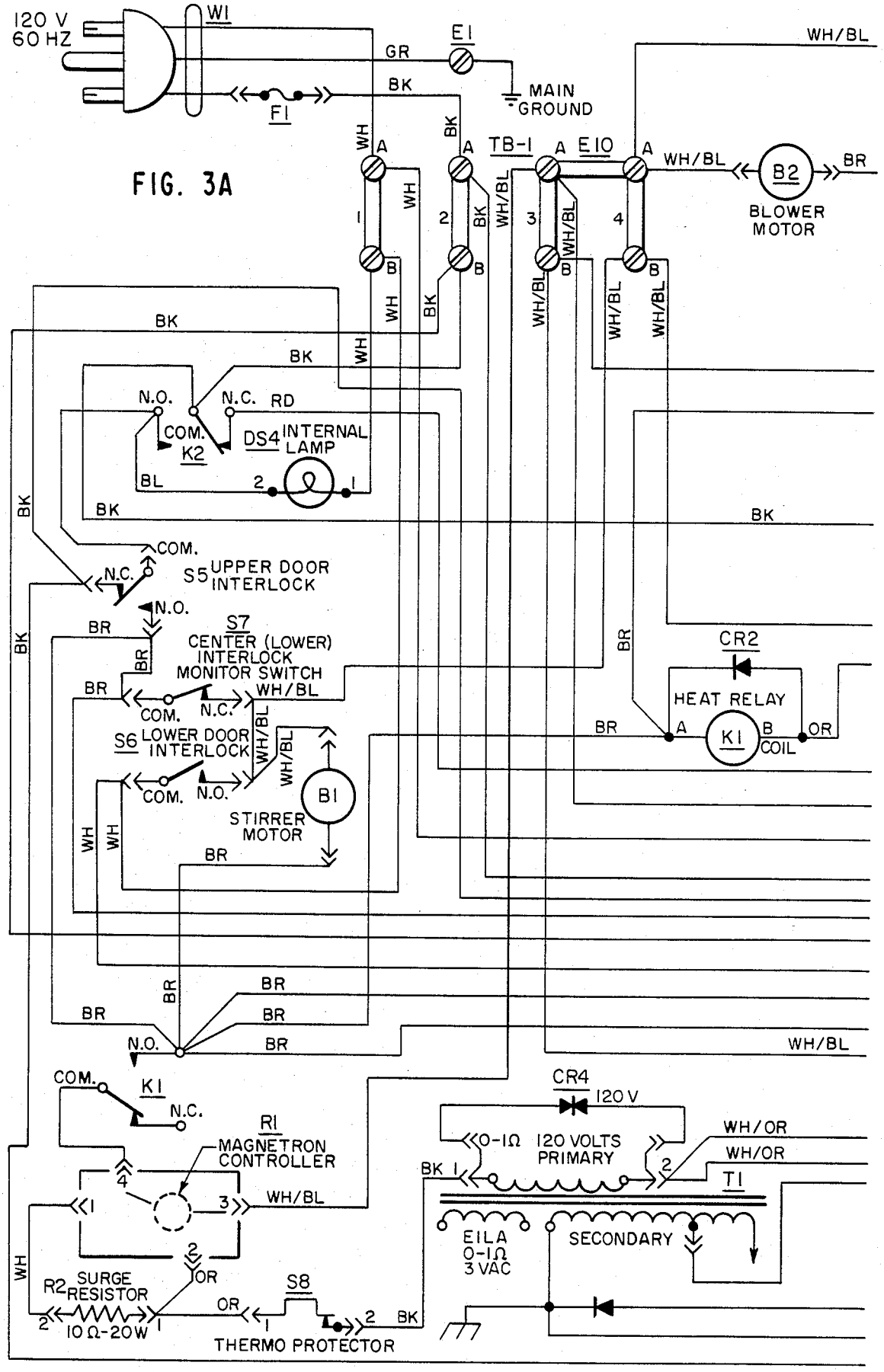
FIGS. 3A, 3B and 3C form a composite schematic diagram of the electrical control circuitry for the present invention.
Figure 3B:
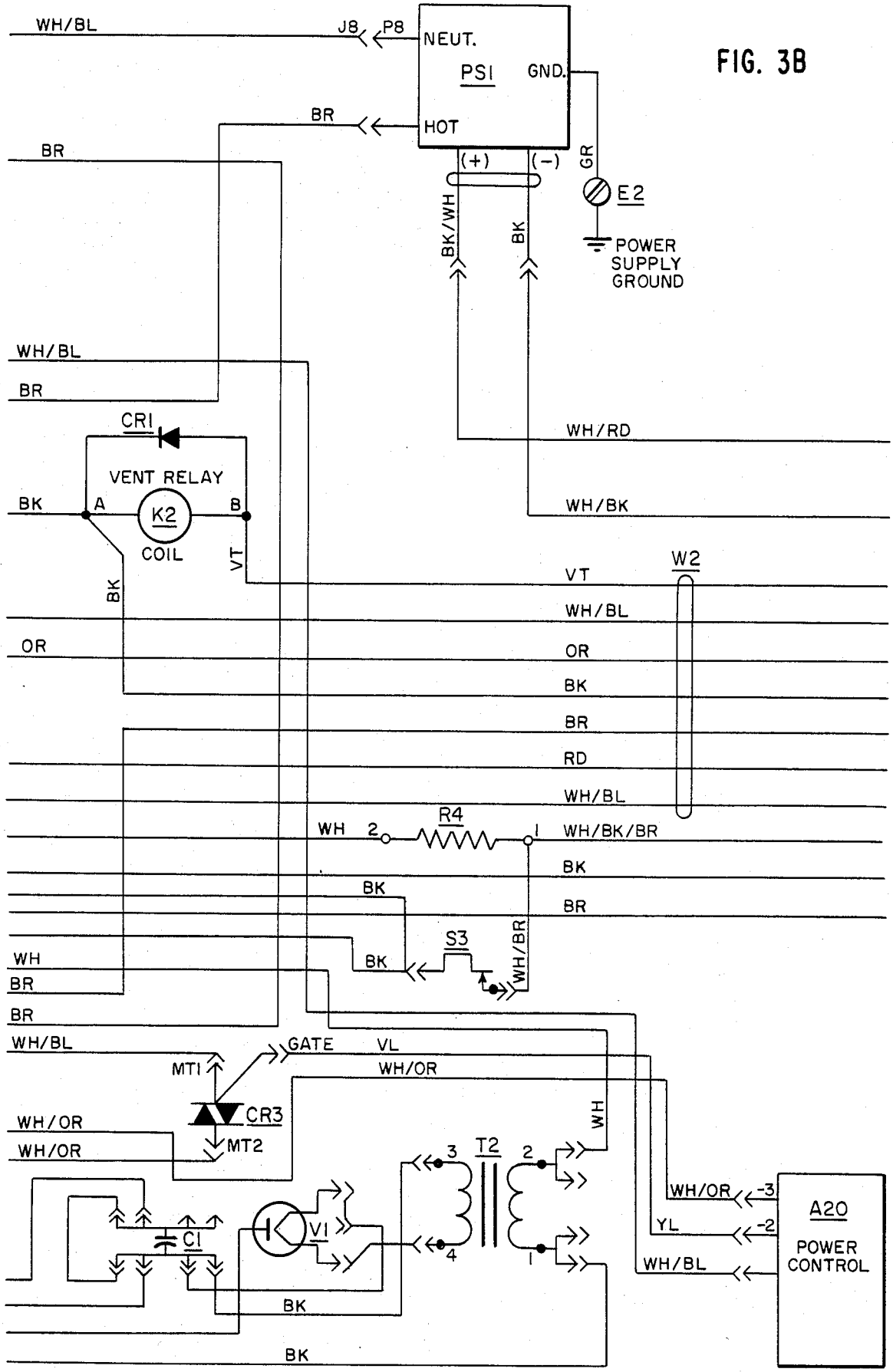
Figure 3C:
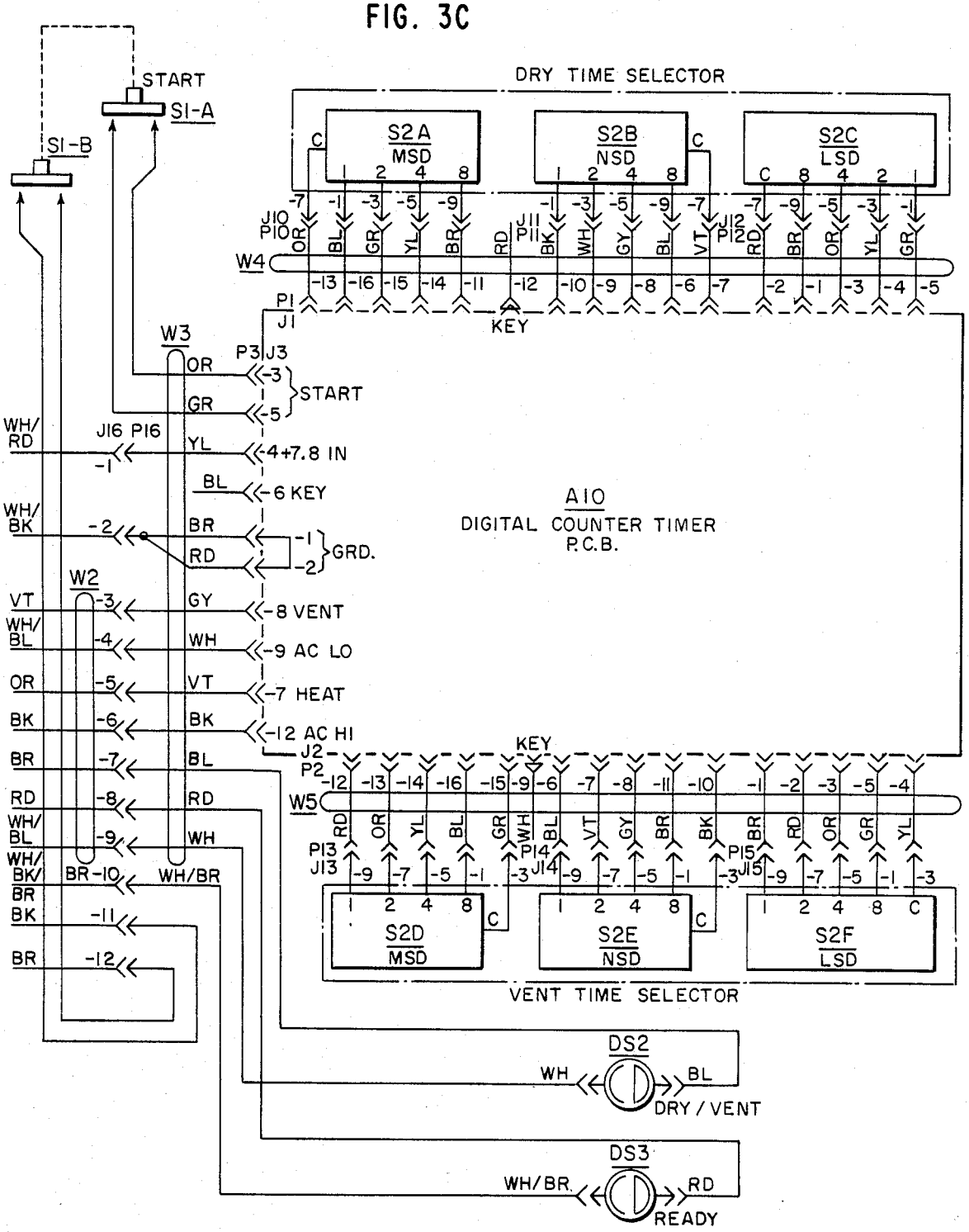
Figure 7:
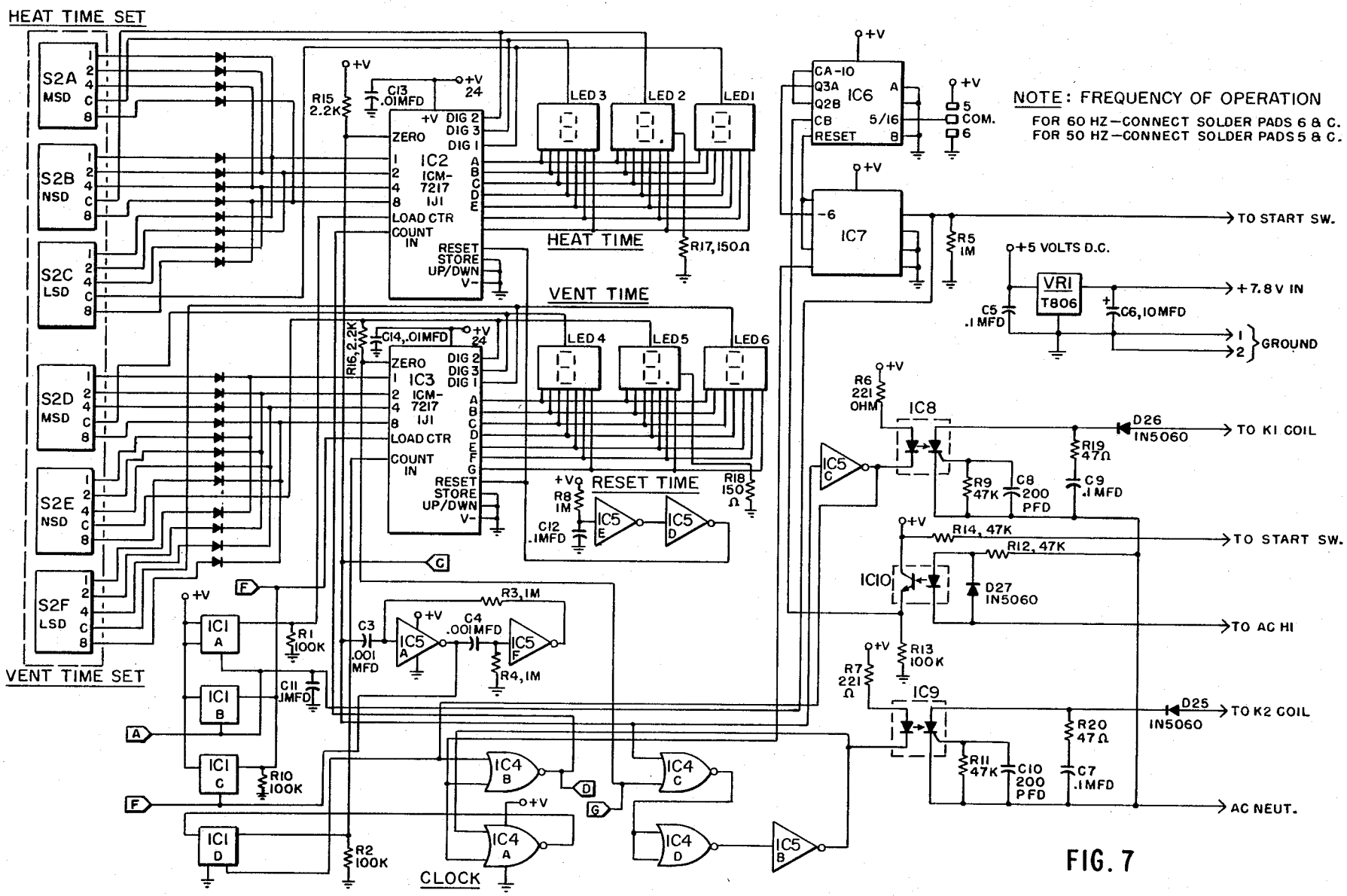
FIG. 7 is a schematic diagram showing the circuitry for the timer printed circuit board.

FIGS. 3A, 3B and 3C depict a composite schematic diagram of the electrical control circuitry. Looking at the upper portion of the FIG. 3C schematic, the electrical elements behind the heat time set switch can be seen. The switches S2A, S2B, S2C as appropriately turned by a user (Heat Time Set switch 28) to the desired heat time, are connected into the digital counter timer printed circuit board A10. The schematic diagram of FIG. 7 shows the electrical connections of timer A10. In FIG. 3C just below the printed circuit board A10 are the switches S2D, S2E and S2F of the vent time set switch 30. Below this are shown the panel lamps DS2 and DS3; DS2 being for the indication of energization of the heating (drying) and ventilation circuits (panel light 27), and the DS3 panel light indicating magnetron "ready" (light 26). In the lower third of the FIG. 3C schematic is shown the input from the power control schematic A20 (FIG. 6).

Looking at the lower portion of FIG. 3B, the power transformer T2, the voltage control circuitry for the magnetron B1, and the Triac CR3 can be seen. The bottom of the schematic of FIG. 3A shows the varistor assembly CR4, and the magnetron controller R1. The surge resistor R2 and a thermoprotector S8 are provided for protection of the device. In the middle portion of the diagram of FIG. 3A the interlock structure for the oven door, the connections for the stirrer motor B1, the heat relay K1 for magnetron energization, and the relay K2 for the vent blower motor B2 (indicated at the top of the schematic), are shown.

Figure 4:
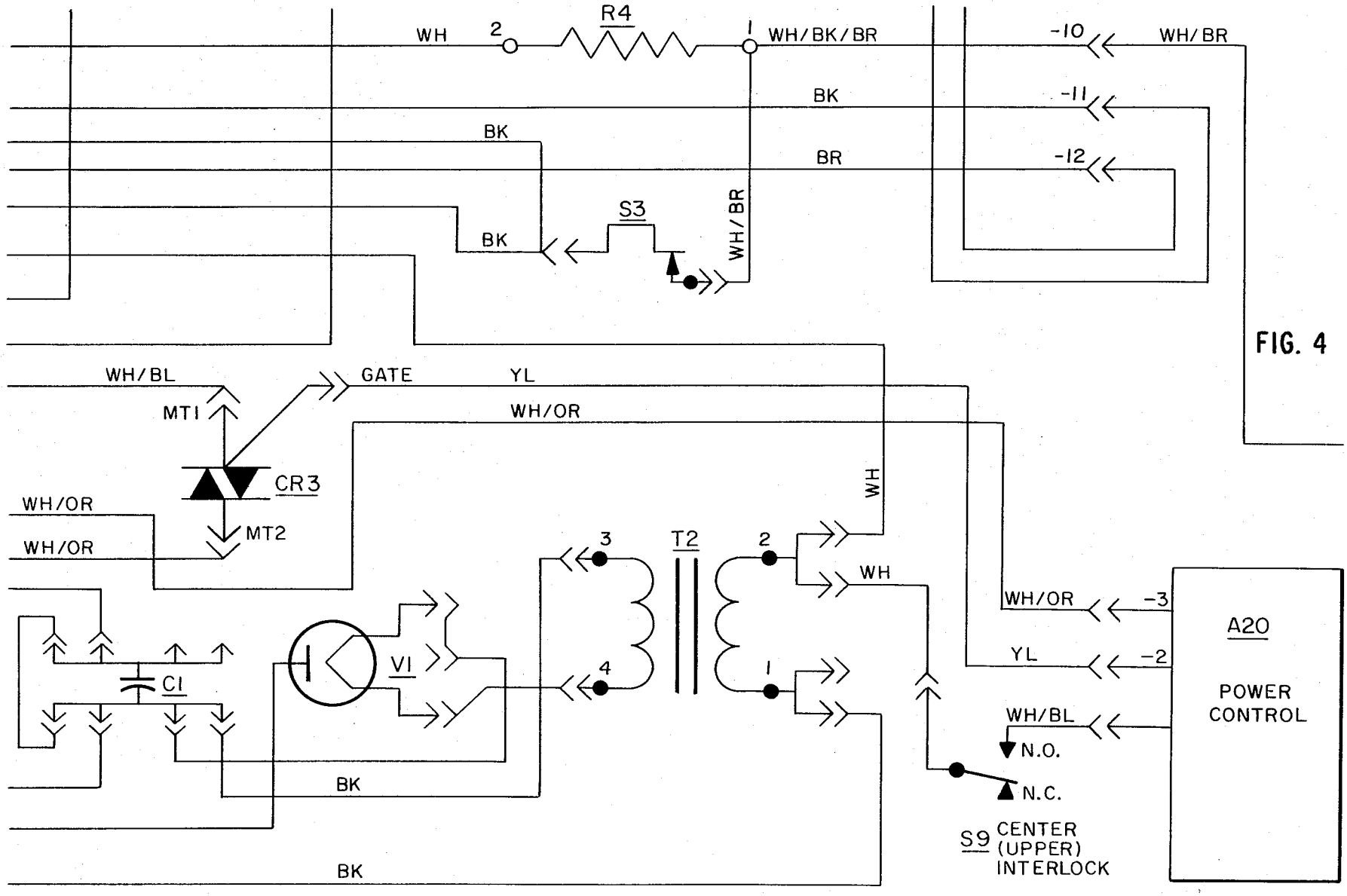
FIG. 4 is an enlarged portion of the lower part of the FIG. 3B wiring showing the resistance heater circuit with thermostatic control.

FIG. 4 is an enlarged portion of the schematic of FIG. 3 showing the magnetron heater resistor R4 and the magnetron thermostatic control S3. Both of these are physically and mechanically connected to the magnetron tube V1 in a manner to be shown and described below.

Figure 5:
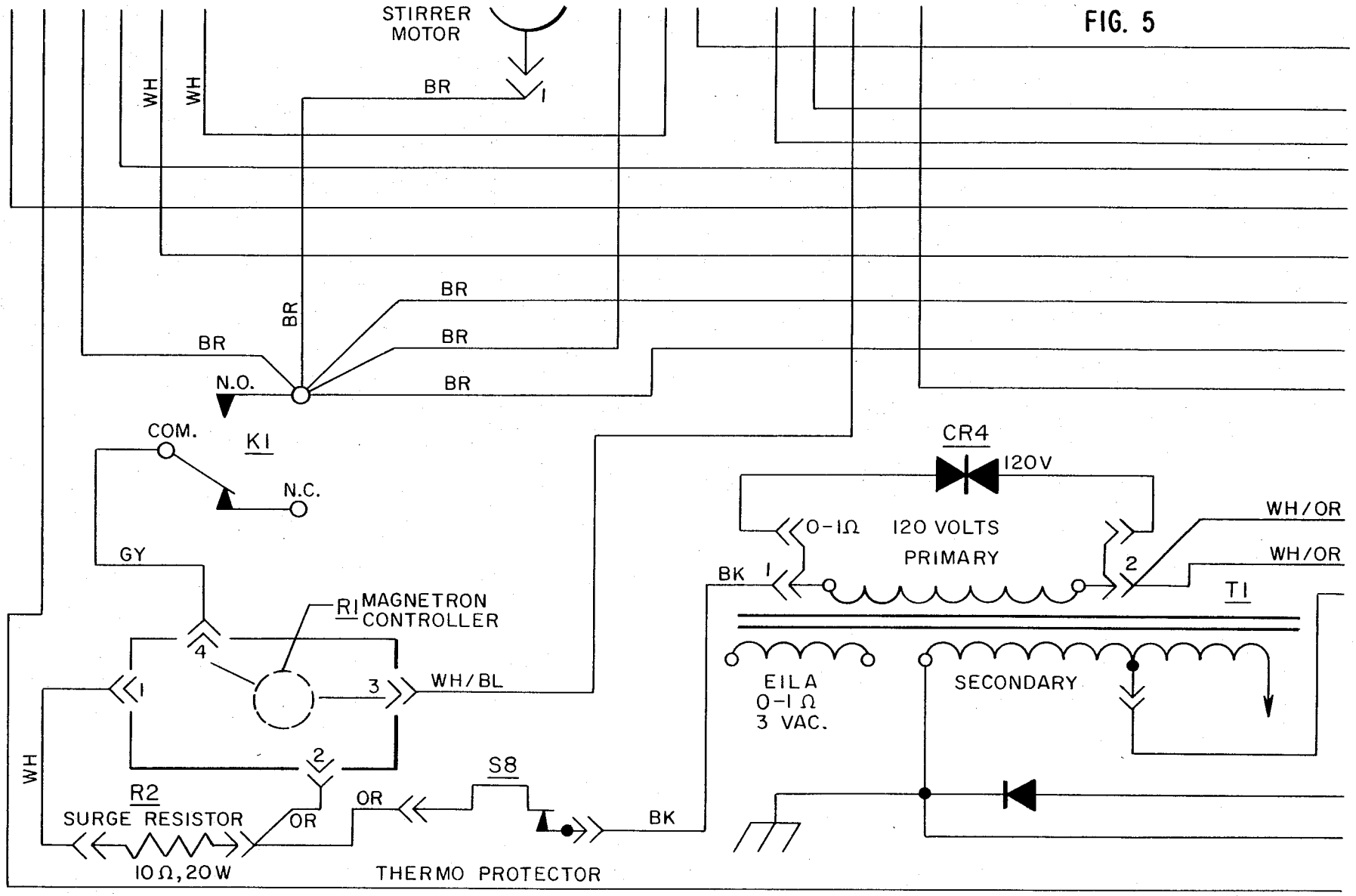
FIG. 5 is an enlarged portion of the lower part of the FIG. 3A wiring showing the magnetron controller with surge resistor and thermo protector.

FIG. 5 is an enlarged schematic view of FIG. 3A showing the magnetron controller R1, the surge resistor R2 and the thermoprotector S8 for the magnetron tube V1.

FIG. 6 is a detailed schematic of the variable power control circuit with the nine push button, percent of power switches, as are provided on a printed circuit board. This is the portion indicated as A20 in the schematic of FIGS. 3C and 4.

FIG. 7 is a schematic diagram of the timer printed circuit board indicated as A10 in the schematic of FIG. 3C. Neither FIG. 6 nor 7 will be described in detail since a functional narrative of the wiring schematic has already been set forth, and a detailed element by element discussion is not believed necessary. However, anyone with an electronics background should be able to indicate from the schematic diagrams the proper electrical hookup for a successful operating device.

Figure 8:
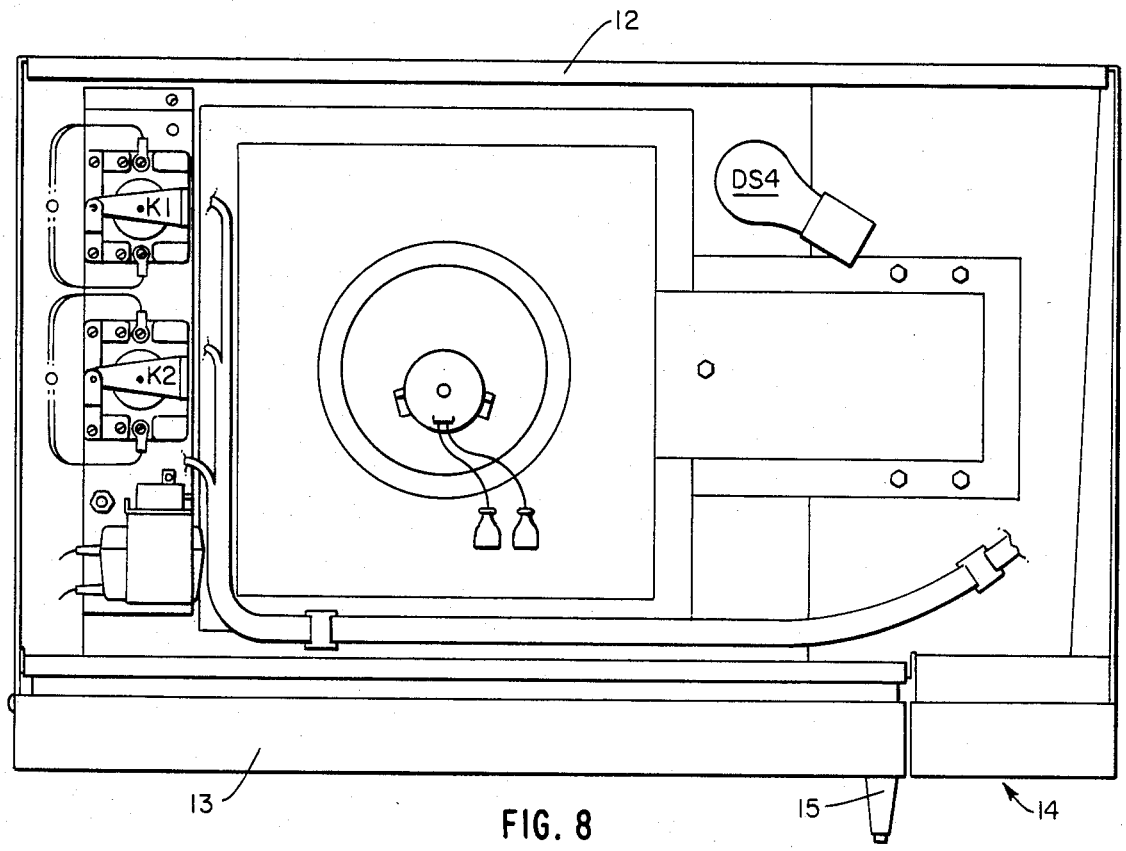
FIG. 8 is a top plan view of the microwave heating device of the present invention.
Figure 9A:
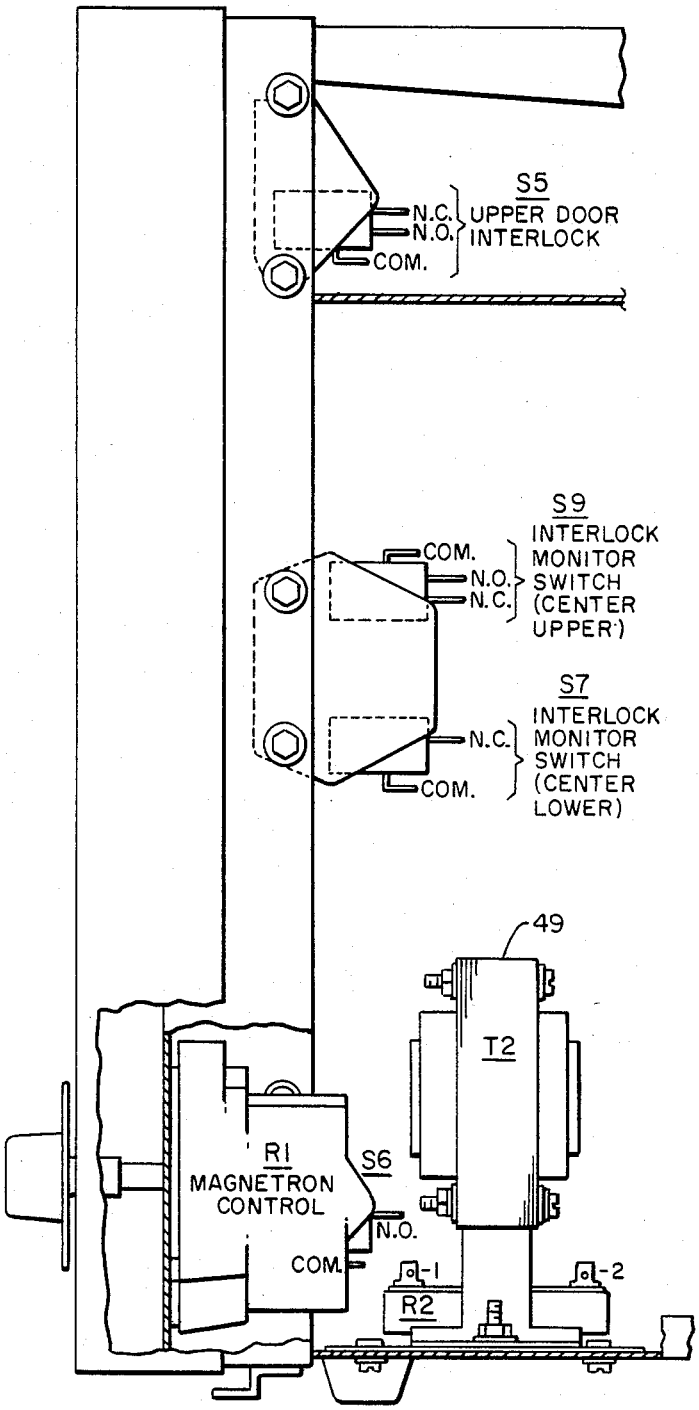
FIGS. 9A and 9B are side elevational views of the front and rear of the the device.
Figure 9B:
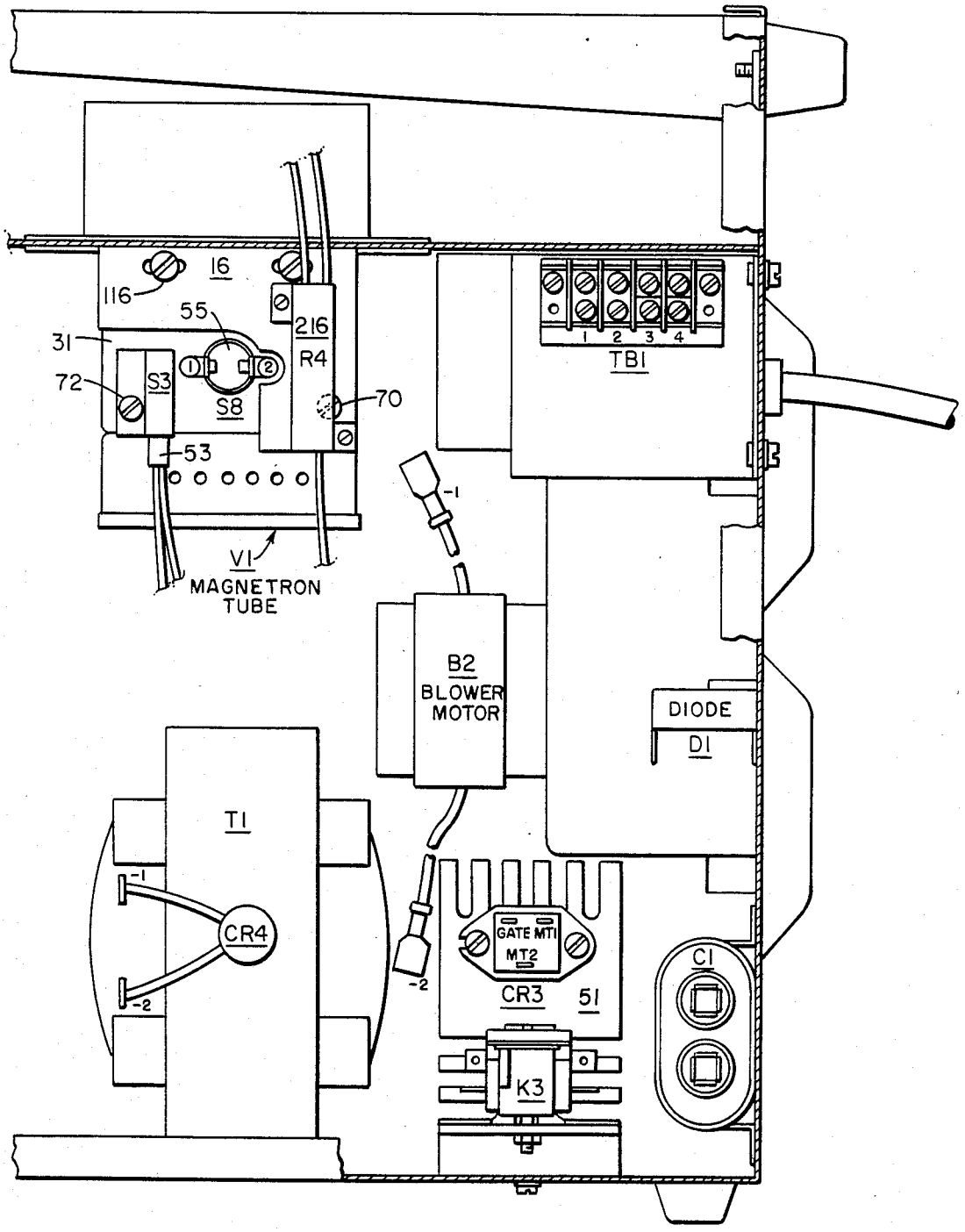

FIGS. 8 and 9A, 9B show respectively top and side views of the structural arrangement of the microwave oven of the present invention. In FIG. 8 the holding relays K1 and K2 are both shown, as well as an interior light DS4 for the oven. The top of door 13, handle 15, and the control panel 14 are also designated. Looking at FIG. 9B, the Triac CR3 is indicated by reference number 51, the blower motor B2, the capacitor C1, the transformer T1, the varistor assembly CR4, and the magnetron tube V1 are all shown. Looking at FIG. 9A, the magnetron controller R1 for changing the pulse power as mounted behind control knob 18 can be seen, also a magnetron filament transformer T2 is indicated by reference numeral 49, and the three interlock switches S5, S7 and S9 for the oven door.

Figure 10:
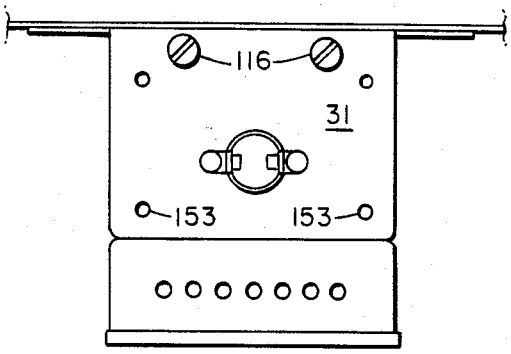
FIG. 10 is a side elevational view of the magnetron tube per se as modified for attachment of the resistance heater and thermostatic control therefor.

As shown in FIG. 9B, and the per se view of FIG. 10, the magnetron tube V1 structurally is provided with tappings for mounting a metal support plate 16. The support plate 16 holds the heater resistance R4 as indicated by 216 for the purpose of providing a good heat conducting contact between the heater resistance R4 and the magnetron tube shell. 53 indicates the physical mounting of the thermostatic control S3 by means of a large head screw 72 directly to the magnetron tube casing. The thermoprotector switch S8 is physically attached at 55 to the magnetron tube 31, and the thermostatic control S3 is similarly physically attached by the additional tapped holes 153. The screws 116 physically attach and secure the support plate 16 to the magnetron tube casing.

During normal operation of the microwave oven of the present invention, the samples to be heated are prepared, after the oven itself has been plugged into the 110 volt alternating current line. After the oven has been plugged in, the magnetron heater resistance R4 will be energized to bring the magnetron tube up to the desired operating temperature. Once the desired temperature has been reached, the panel indicator light 26 will come on indicating that the magnetron is "ready" for the most efficient state of operation. The operator of the device then adjusts the percentage power buttons 19 from 10 to 100 percent power, and turns the pulse power control knob 18 between maximum and minimum for the desired pulse power cycling of the magnetron. The amount of time desired for heating the particular test samples is then set by the upper thumb switch 28 and correspondingly the vent time thumb switch 30 is set for venting time, if such is desired. After placing the samples in position within the oven chamber, the start button 24 is pushed to energize the magnetron and perform the desired heating of the samples. At the conclusion of the heating cycle, the vent blower may or may not continue to run depending upon whether additional time has been set into the vent time thumb switch 30. If the time here indicates zero, then the vent blower motor B2 will turn off at the same time as the magnetron. However, it has been discovered that for the most efficient type operation, it is desirable to continue to vent the oven for some time after the actual heating process has been concluded.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A heating device for use in laboratories and the like comprising:

an oven-type housing;

apparatus for generating microwaves for drying sample materials within said oven-type housing;

means for energizing the microwave generating apparatus for drying for a given portion of a cycle of input power depending upon a desired heat output setting for achieving substantially uniform heating; and apparatus in heat conducting contact with said microwave generating apparatus for holding the microwave generating apparatus at practically a constant temperature for the purpose of providing an extremely steady output therefrom.

2. A heating device as set forth in claim 1, wherein said apparatus for generating microwaves includes a magnetron tube.

3. A heating device as set forth in claim 2, wherein said apparatus for holding the microwave generating apparatus at a constant temperature includes a resistance heater physically attached to said magnetron tube, together with a thermostatic control of a high degree of accuracy also physically attached to said magnetron, and being connected in the electrical circuit with said heater to accurately control the degree of heating thereof.

4. A heating device as set forth in claim 1, wherein said means for energizing the microwave generating apparatus for drying includes variable energizing means to vary the amount of energization from 10 percent to 100 percent of the available input power.

5. A heating device as set forth in claim 4, wherein said variable energizing means for varying the amount of power from 10 to 100 percent comprises a plurality of switches arranged so that the desired percentage of power can be selected within the aforesaid range.

6. A heating device as set forth in claim 1, wherein said apparatus for holding the microwave generating apparatus at a constant temperature includes a resistance heater physically attached to the microwave generating apparatus, together with a thermostatic control of a high degree of accuracy also physically attached thereto and being connected in the electrical circuit with said heater to accurately control the degree of heating thereof.

7. A microwave device for drying test samples containing water comprising:

a housing containing a sample receiving chamber;

magnetron means in said housing for producing microwaves for heating the test samples;

means for energizing the magnetron means for a desired heat output; and means in heat conducting contact with said magnetron means for heating said magnetron means to a desired temperature for increasing the stability of output therefrom.

8. A heating device as set forth in claim 7, wherein said means for energizing the magnetron means includes variable energizing means to vary the amount of energization from 10 percent to 100 percent of the available input power.

9. A heating device as set forth in claim 8, wherein said variable energizing means for varying the amount of power from 10 to 100 percent comprises a plurality of switches arranged so that the desired percentage of power can be selected within the aforesaid range.

10. A heating device as set forth in claim 8, wherein said means for heating said magnetron means to a desired temperature includes a resistance heater physically attached to a magnetron tube, together with a thermostatic control of a high degree of accuracy also physically attached to the magnetron tube, and being electrically connected in series with said heater for accurately controlling the degree of heating thereof.

11. A heating device as set forth in claim 7, wherein said means for heating said magnetron means to a desired temperature includes a resistance heater physically attached to said magnetron means, together with a thermostatic control of a high degree of accuracy also physically attached to said magnetron means, and being electrically connected in series with said heater to accurately control the degree of heating thereof.

12. A heating device comprising:

an oven-type housing having a door opening to an oven chamber for receiving materials to be heated, a magnetron system including a magnetron tube within the housing connected to the oven chamber for providing microwave energy thereto when the magnetron tube is suitably energized, a plurality of switches for controlling the percentage of input power to the magnetron tube, a pulse power control for changing cycle periods of energization for the magnetron tube, and means in heat conducting contact with said magnetron tube for holding the magnetron tube at a predetermined constant temperature during operation of the device.

13. A heating device as set forth in claim 12, wherein said means for holding the magnetron tube at a predetermined constant temperature includes a heater element attached to said magnetron tube for heating same.

14. A heating device as set forth in claim 13, wherein said means for holding the magnetron tube at a predetermined constant temperature further includes a control element which is temperature responsive also attached to said magnetron tube for accurately maintaining energization of said heater element.

15. A heating device as set forth in claim 14, further including a venting system operable simultaneously with said magnetron tube, and also controllable for venting the oven for desired period of time following succession of energization of the magnetron tube.

16. A heating device as set forth in claim 15, further including a timer for controlling both the heating and venting operations of the device.

17. A heating device as set forth in claim 16, further including a panel light for indicating the heating of the magnetron tube to the predetermined operating temperature by a "ready" indication.

18. A heating device as set forth in claim 16, further including a panel light for indicating energization of the heating and/or venting operations while in progress.

* * * * *